US012018471B2

(12) United States Patent
Jiang et al.

(10) Patent No.: US 12,018,471 B2
(45) Date of Patent: Jun. 25, 2024

(54) FLUSH TOILET

(71) Applicant: XIAMEN AXENT CORPORATION LIMITED, Fujian (CN)

(72) Inventors: Changfa Jiang, Fujian (CN); Jin Chen, Fujian (CN); Ting Huang, Fujian (CN)

(73) Assignee: XIAMEN AXENT CORPORATION LIMITED, Fujian (CN)

( * ) Notice: Subject to any disclaimer, the term of this patent is extended or adjusted under 35 U.S.C. 154(b) by 146 days.

(21) Appl. No.: 17/642,646

(22) PCT Filed: Sep. 18, 2020

(86) PCT No.: PCT/CN2020/116111
§ 371 (c)(1),
(2) Date: Mar. 11, 2022

(87) PCT Pub. No.: WO2021/052454
PCT Pub. Date: Mar. 25, 2021

(65) Prior Publication Data

US 2022/0412065 A1 Dec. 29, 2022

(30) Foreign Application Priority Data

Sep. 19, 2019 (CN) ..... 201910884571.9

(51) Int. Cl.
*E03D 1/38* (2006.01)
*E03D 11/08* (2006.01)

(52) U.S. Cl.
CPC ..... *E03D 1/38* (2013.01); *E03D 11/08* (2013.01)

(58) Field of Classification Search
CPC ..... E03D 1/38
See application file for complete search history.

(56) References Cited

U.S. PATENT DOCUMENTS

2015/0275494 A1 10/2015 Kashirajima
2016/0040417 A1 2/2016 Shinohara
(Continued)

FOREIGN PATENT DOCUMENTS

CN 201459885 U 5/2010
CN 102363972 A 2/2012
(Continued)

OTHER PUBLICATIONS

The State Intellectual Property Office of People's Republic of China: First Office Action in Chinese Application No. 201910884571.9; dated Feb. 23, 2022; 20 pages, including English translation.
(Continued)

*Primary Examiner* — Lauren A Crane
(74) *Attorney, Agent, or Firm* — Schwabe, Williamson & Wyatt, PC

(57) ABSTRACT

A flush toilet, comprising a washing water supply portion which has a water outlet and a water inlet configured to connect to an external water supply pipe, is disclosed. Water flowing in from the water inlet flows from a first water inlet pipe to a second water inlet pipe, and then flows from the second water inlet pipe to the water outlet, a flow sectional area of the first water inlet pipe is smaller than a flow sectional area of the water inlet, and a flow sectional area of the second water inlet pipe is larger than the flow sectional area of the first water inlet pipe.

19 Claims, 6 Drawing Sheets

(56) References Cited

U.S. PATENT DOCUMENTS

| | | | | |
|---|---|---|---|---|
| 2016/0222641 | A1* | 8/2016 | Urata | E03D 11/08 |
| 2017/0241120 | A1 | 8/2017 | Matsuo et al. | |
| 2019/0345707 | A1 | 11/2019 | Kuroki | |

FOREIGN PATENT DOCUMENTS

| | | | |
|---|---|---|---|
| CN | 203594087 | U | 5/2014 |
| CN | 204401748 | U | 6/2015 |
| CN | 104947772 | A | 9/2015 |
| CN | 105369866 | A | 3/2016 |
| CN | 205259310 | U | 5/2016 |
| CN | 105839752 | A | 8/2016 |
| CN | 207830761 | U | 9/2018 |
| CN | 211113960 | U | 7/2020 |
| DE | 102017127190 | A1 | 5/2019 |
| EP | 3215682 | B1 | 7/2019 |
| JP | H08177112 | A | 7/1996 |
| JP | 2009150160 | A | 7/2009 |
| JP | 2013170396 | A | 9/2013 |
| JP | 2014062431 | A | 4/2014 |
| JP | 2015068125 | A | 4/2015 |
| JP | 2017040132 | A | 2/2017 |
| JP | 2018105006 | A | 7/2018 |
| JP | 2018123551 | A | 8/2018 |
| JP | 2019027214 | A | 2/2019 |

OTHER PUBLICATIONS

International Search Report and Written Opinion for PCT/CN2020/116111 dated Dec. 16, 2020; 14 pages, including English translation of Search Report.

European Patent Office, Extended European Search Report for EP Application No. 20866186.8 dated Aug. 21, 2023; 9 pages.

* cited by examiner

FLUSH TOILET

CROSS-REFERENCE TO RELATED APPLICATION

The present application is a national phase entry under 35 U.S.C. § 371 of International Application No. PCT/US2020/116111, filed Sep. 18, 2020, which designates the United States of America, which claims the priority to Chinese Patent Application No. 201910884571.9, titled "FLUSH TOILET", filed with the China National Intellectual Property Administration on Sep. 19, 2019, the entire disclosures of each of these applications are hereby incorporated by reference in their entireties and for all purposes.

FIELD

The present application relates to a flush toilet.

BACKGROUND

At present, related regulations on the discharge effect of suspended sewage from a toilet exist in standards of various nation-s, especially in European regions where a flush-from-rear toilet is mainly used. In EN997 standard, in the case of a full-discharge CLASS1 toilet and a half-discharge CLASS2 toilet, tissues tossed on a cleaning surface of the toilet shall be completely discharged, which sets higher requirements for the sewage discharge function of the toilet. The existing flush-from rear toilet generally adopts water-flushing to discharge sewage. After entering a water inlet pipe, the water is flushed toward a water-guide ring of the cleaning surface; a large amount of flushing water quickly converges and falls to a water-storage bay, and then flushes the filth out. Since it is difficult for the discharged water to cover the suspended filth on the entire water-sealing surface, the suspended or semi-suspended filth in the water tends to roll up and down in a filth receiving portion and is difficult to be discharged from the toilet. In addition, when the existing toilet is flushed and cleaned, on one hand, a large amount of water may instantly converge at a water outlet and collide with the air to produce abnormal noise when a flushing switch is turned, and on the other hand, a large amount of water falling on a ceramic wall or the water-sealing surface may produce large noise and affect others.

SUMMARY

A main object according to the present application is to overcome the above disadvantages in the conventional technology and provide a flush toilet. The flush toilet includes a basin portion, a sewage pipe and a washing water supply portion, wherein

- the basin portion has a filth receiving surface, an inner edge portion formed on an upper portion of the filth receiving surface, and a recess formed on a lower portion of the filth receiving surface; and the recess has a peripheral wall connected to the lower portion of the filth receiving surface;
- an inlet of the sewage pipe is in communication with the recess;
- the washing water supply portion has a water outlet arranged at the inner edge portion; and
- a first flow guide portion is formed on the filth receiving surface, the washing water flows out from the water outlet to a front portion of the filth receiving surface, and is guided by the first flow guide portion to flow toward the inlet of the sewage pipe to form a first water flow; a second flow guide portion is formed at a rear portion of the filth receiving surface, the washing water flows out along an inner peripheral surface of the inner edge portion from the water outlet to the rear portion of the filth receiving surface, and is guided by the second flow guide portion to rotate along a peripheral wall of the recess to form a second water flow; the first water flow and the second water flow act together to generate a vortex to agitate the filth and discharge the filth from the sewage pipe.

Preferably, the first flow guide portion has a protrusion formed on the filth receiving surface, and the protrusion is formed by protruding inward one side surface of the filth receiving surface in a left-right direction.

Preferably, the protrusion is formed on a side opposite to the water outlet in the left-right direction, a front surface of the protrusion forms a flow guide surface of the first flow guide portion, and the flow guide surface is inclined downward toward the inlet of the sewage pipe.

Preferably, the washing water flowing out from the water outlet to the front portion of the filth receiving surface partially collides with the protrusion to roll, and then falls from a side wall of the protrusion.

Preferably, the first flow guide portion has a first receiving surface formed on one side of the water outlet and a second receiving surface formed on another side of the water outlet in a left-right direction of the filth receiving surface, the second receiving surface is formed at a height lower than the first receiving surface, and a rear end of the second receiving surface is directed toward the inlet of the sewage pipe.

Preferably, the second flow guide portion is a flow guide wall surface formed at a rear portion of the filth receiving surface, and the flow guide wall surface is in smooth transition with the peripheral wall on a rear side of the recess.

Preferably, a third flow guide portion is formed on the filth receiving surface close to the water outlet, part of the water flowing out of the water outlet is guided by the third flow guide portion to rotate along the peripheral wall of the recess to form a third water flow, and a rotation direction of the third water flow is consistent with a rotation direction of the second water flow.

Preferably, the recess has a bottom surface formed in a front region under the water sealing surface, and the bottom surface is connected to the peripheral wall of the recess located on the front side.

Preferably, the bottom surface is formed horizontally or inclined backward and downward.

Preferably, the bottom surface smoothly transitions downward from one side to another side in a left-right direction, and the transition from high to low of the bottom surface is consistent with a flow direction of the second water flow.

Preferably, the water outlet of the washing water supply portion is located on the rear side of the recess or the rear portion of the recess in a front-rear direction.

Preferably, the flush toilet further includes a water inlet configured to connect to an external water supply pipe, the water flowing in from the water inlet is throttled by a throttling port, then flows from a first water inlet pipe to a second water inlet pipe, and then flows from the second water inlet pipe to the water outlet. A flow sectional area of the first water inlet pipe is larger than a flow sectional area of the throttling port, a flow sectional area of the second water inlet pipe is larger than the flow sectional area of the first water inlet pipe, and the second water inlet pipe gradually widens to the water outlet.

Preferably, the third flow guide portion is an inclined surface formed on a front side of the water outlet, and the inclined surface smoothly transitions downward from the water outlet to the peripheral wall of the recess.

Preferably, a corner portion greater than 90 degrees is formed between a front surface of the protrusion and the filth receiving surface.

Preferably, the first flow guide portion has a groove formed on the front portion of the filth receiving surface, and the groove is inclined downward toward the inlet of the sewage pipe.

Preferably, the filth receiving surface is formed with a fourth flow guide portion on one side of the washing water supply portion, the washing water flowing out from the water outlet to the front portion of the filth receiving surface is guided by the fourth flow guide portion to converge with the washing water flowing out of the water outlet and along the inner peripheral surface of the inner edge portion, and most of the washing water after confluence forms the first water flow under guidance of the first flow guide portion.

According to the above description of the present application, compared with the conventional technology, the present application has the following beneficial effects.

1, in the present application, the washing water flowing out from the water outlet forms two water flows under the action of the first flow guide portion and the second flow guide portion, and generates a vortex under the combined action of the two water flows to agitate the filth, which greatly improves the flushing capacity of the toilet.

2, the protrusion, formed by protruding inward one side surface of the filth receiving surface in the left-right direction, guides the washing water, which has a simple structure and a good flow guide effect.

3, the protrusion is formed on a side opposite to the water outlet in the left-right direction, the flow guide surface is inclined downward toward the inlet of the sewage pipe, and the first water flow can smoothly flow to the sewage pipe and promote the rotation of the second water flow.

4, the corner portion greater than 90 degrees is formed between the front surface of the protrusion and the filth receiving surface, so that the washing water flows smoothly and there is no sanitary dead space.

5, the second flow guide portion is a flow guide wall surface formed at a rear portion of the filth receiving surface, and the flow guide wall surface is in smooth transition with the peripheral wall on a rear side of the recess, which is conductive to the formation of the swirling of the second water flow.

6, the third flow guide portion is formed on the filth receiving surface close to the water outlet, part of the water flowing out of the water outlet is guided by the third flow guide portion to rotate along the peripheral wall of the recess to form the third water flow, and the rotation direction of the third water flow is consistent with the rotation direction of the second water flow, which can accelerate the rotation of the second water flow and facilitate the discharge of the sewage.

7, the recess has the bottom surface formed in the front region under the water sealing surface, the bottom surface is connected to the peripheral wall of the recess located on the front side, and the bottom surface is formed horizontally or inclined backward and downward, the filth suspended in the recess is directly flushed to the sewage pipe by the washing water, so as to avoid difficult discharge of the filth due to remaining and swirling in the recess.

8, the bottom surface smoothly transitions downward from one side to another side in the left-right direction, and the transition from high to low of the bottom surface is consistent with the flow direction of the second water flow, which can accelerate the rotation of the second water flow and facilitate the discharge of the sewage.

9, the water outlet of the washing water supply portion is located on the rear side of the recess or the rear portion of the recess, so that the water from one sole water outlet can wash over the entire basin portion.

10, since the flushing water reaches the water outlet after being decelerated twice by the first water inlet pipe and the second water inlet pipe, the noise generated by entering of water is significantly reduced.

DETAILED DESCRIPTION OF THE EMBODIMENTS

Figure 1:
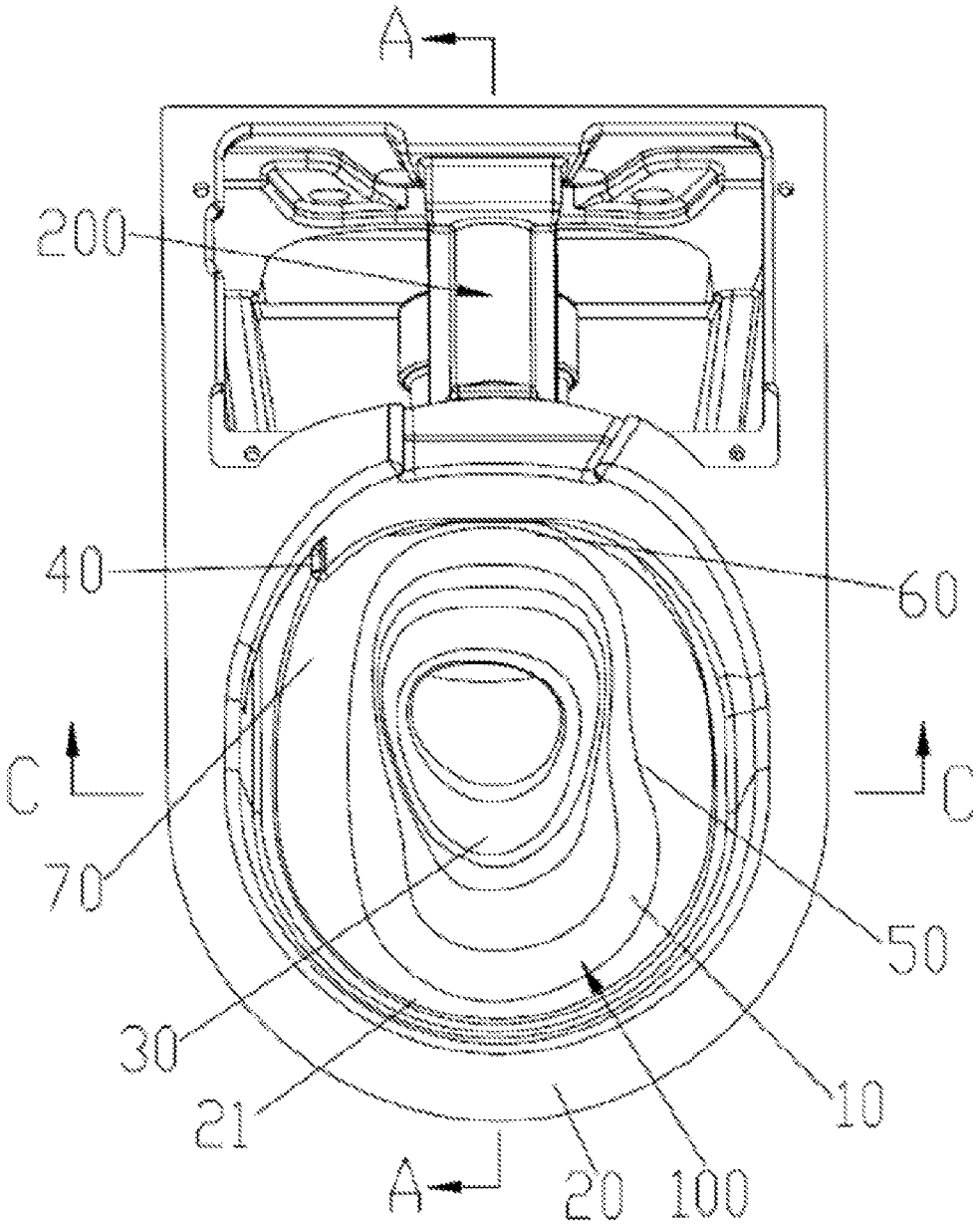
FIG. 1 is a top view of a flush toilet according to the present application.

The present application will be further described below with reference to the drawings. For the ease of description, the positional relationships of "front", "rear", "left" and "right" hereinafter are explained as follows: the toilet is generally placed close to a wall, and the water supply pipe is led out from the wall; when a man approaches the toilet and overlooks the toilet, FIG. 1 is what he saw. It is defined that, "bottom" in FIG. 1 is the "front" in the following description, "top" in FIG. 1 is the "rear" in the following description, "left" in FIG. 1 is the "left" in the following description, and "right" in FIG. 1 is the "right" in the following description.

As shown in FIGS. 1 to 5, a flush toilet according to the present application includes a basin portion 100, a washing water supply portion 200 and a sewage pipe 300. In the flush toilet of this embodiment, washing water is provided by a water storage tank (not shown) to the washing water supply portion 200 of the flush toilet according to the present application. The washing water supply portion 200 has a water inlet 41 configured to connect to the water storage tank, the water flowing in from the water inlet 41 is throttled by a throttling port 44, then flows from a first water inlet pipe 42 to a second water inlet pipe 43, and then flows from the second water inlet pipe 43 to a water outlet 40, and finally the washing water flows toward the front from the water outlet 40 to wash the basin portion 100. A flow sectional area of the first water inlet pipe 42 is larger than a flow sectional area of the throttling port 44, a flow sectional area of the second water inlet pipe 43 is larger than the flow sectional area of the first water inlet pipe 42, and the second water inlet pipe 43 gradually widens to the water outlet 40. Preferably, the flow sectional area of the throttling port 44 is 25% to 50% of a flow sectional area of the water inlet 41, the flow sectional area of the first water inlet pipe 42 is 120% to 150% of the flow sectional area of the throttling port 44, the flow sectional area of the second water inlet pipe 43 is 250% to 350% of the flow sectional area of the throttling port 44, and a flow sectional area of the water outlet 40 is 300% to 400% of the flow sectional area of the throttling port 44. Undoubtedly, the flow sectional area of the first water inlet pipe is smaller than the flow sectional area of the water inlet, and the flow sectional area of the second water inlet pipe is larger than the flow sectional area of the first water inlet pipe. The flow sectional area of the first water inlet pipe is 30% to 75% of the flow sectional area of the water inlet, and the flow sectional area of the second water inlet pipe is 5/3 to 35/12 of the flow sectional area of the first water inlet pipe. The flow sectional area of the water outlet is 75% to 200% of the flow sectional area of the water inlet. In this embodiment, the washing water supply portion has only one water outlet in communication with the water inlet.

Figure 2:
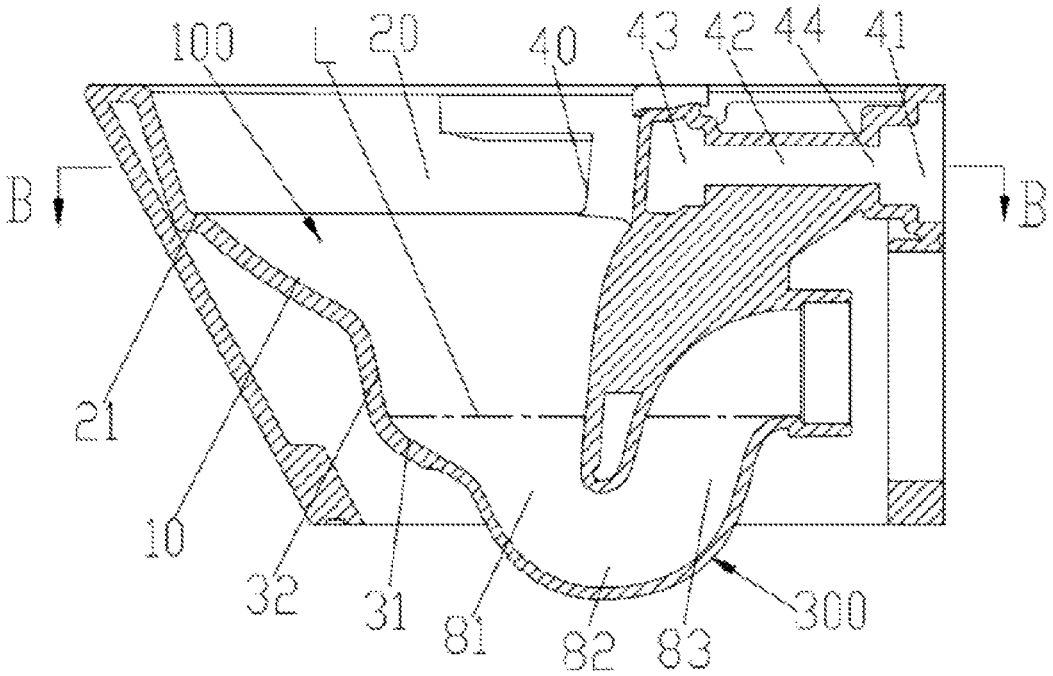
FIG. 2 is a sectional view of the flush toilet taken along A-A of FIG. 1 according to the present application.
Figure 3:
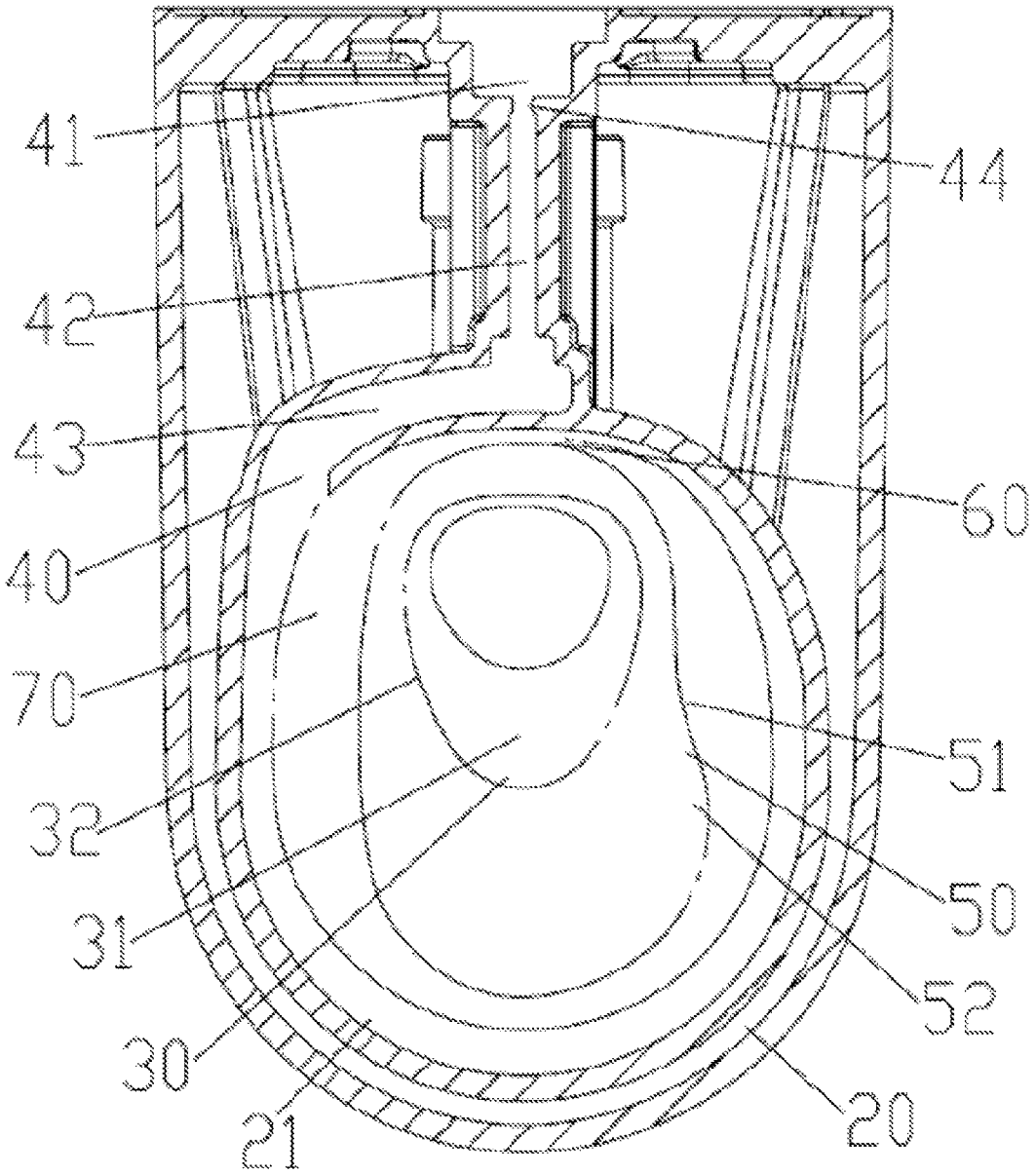
FIG. 3 is a sectional view of the flush toilet taken along B-B of FIG. 2 according to the present application.

In this embodiment, the basin portion 100 has a filth receiving surface 10, an inner edge portion 20 formed on an upper portion of the filth receiving surface 10, and a recess 30 formed on a lower portion of the filth receiving surface 10; and the recess 30 has a peripheral wall 32 connected to the lower portion of the filth receiving surface 10. As shown in FIG. 2, an inner peripheral surface of the inner edge portion 20 has a shape that slightly extends outward, and the inner edge portion 20 has a certain height so that the washing water swirling in a horizontal direction, which is described later, does not splash out. The shape of the inner edge portion 20 may be vertical or may be of extending inward.

The water outlet 40 of the washing water supply portion 200 is formed on a left side of the inner peripheral surface of the inner edge portion 20 of the basin portion 100, and the water outlet 40 is located on a rear side of the recess 30 or a rear portion of the recess 30, so that the water from the water outlet 40 can wash over the entire basin portion 100. The water outlet 40 is smoothly connected to the filth receiving surface 10, so that the washing water flowing out of the water outlet 40 can flow against the filth receiving surface 10. In order to enable part of the water flowing out of the water outlet 40 to flow to a rear portion of the filth receiving surface 10 along the inner peripheral surface of the inner edge portion 20, in this embodiment, a basin-shaped water guide passage 21 for guiding the washing water is formed in an area below the inner peripheral surface of the inner edge portion 20, and the water guide passage 21 is formed substantially horizontally on an outer peripheral portion of the filth receiving surface 10, as shown in FIG. 2. A bottom surface of the water outlet 40 is substantially continuous with a surface of the water guide passage 21, and the water guide passage 21 can guide part of the washing water flowing out of the water outlet 40 to the rear portion of the filth receiving surface 10 along the inner peripheral surface of the inner edge portion 20.

In this embodiment, the sewage pipe 300 has an introduction pipe 81, a bottom portion 82 and a rising pipe 83. The introduction pipe 81 serves as an inlet of the sewage pipe 300 and is connected to the recess 30 with a smooth and continuous curved surface, and extends backward and downward. The washing water flowing from the recess 30 into the introduction pipe 81 flows smoothly in the introduction pipe 81 to the bottom portion 82, and then flows from the bottom portion 82 to the rising pipe 83, and is finally discharged to the outside of the flush toilet.

The recess 30 of the basin portion 100 has a bottom surface 31 formed in a front region under a water sealing surface L, the bottom surface 31 is connected to the peripheral wall 32 of the recess located on the front side, and the introduction pipe 81 is connected to the bottom surface 31. In addition, the bottom surface 31 is formed in an area closer to the front than the introduction pipe 81, and may be formed substantially horizontally, or be inclined backward and downward (the bottom surface may be a flat surface or a curved surface). Due to the existence of the bottom surface 31, the filth suspended in the recess 30 is directly flushed to the sewage pipe by the washing water, so as to avoid difficult discharge of the filth due to remaining and swirling in the recess. The bottom surface 31 smoothly transitions downward from one side to another side in the left-right direction, and the transition from high to low of the bottom surface 31 is consistent with a flow direction of a second water flow. In this embodiment, the left side is higher than the right side of the bottom surface, and the height gradually decreases from the left side to the right side, which can accelerate the rotation of the second water flow and facilitate the discharge of the sewage.

In this embodiment, a first flow guide portion 50, configured to cause the washing water flowing out to a front portion of the filth receiving surface 10 to flow toward the inlet of the sewage pipe, is formed on the filth receiving surface 10, and the first flow guide portion 50 may have a protrusion 51 formed on the filth receiving surface 10, and the protrusion 51 is formed by formed by protruding inward one side surface of the filth receiving surface 10 in a left-right direction. In this embodiment, the protrusion 51 is formed on one side (that is, the right side) opposite to the water outlet 40 in the left-right direction, a front surface of the protrusion 51 is formed as a flow guide surface 52 of the first flow guide portion 50, and the flow guide surface 52 is inclined downward toward an inlet 81 of the sewage pipe. A corner portion greater than 90 degrees is formed between the front surface of the protrusion 51 and the filth receiving surface 10, that is, the corner formed by the protrusion and the non-protrusion of the filth receiving surface 10 is an obtuse angle when the flush toilet is viewed from above. Preferably, the washing water flowing out from the water outlet 40 to the front portion of the filth receiving surface 10 partially collides with the protrusion 51 to roll, and then falls from a side wall of the protrusion 51 and flows to the inlet of the sewage pipe. In general, the washing water flowing from the water outlet 40 to the front portion of the filth receiving surface 10 is guided by the first flow guide portion 50 to flow to the inlet of the sewage pipe to form a first water flow F1. In order to make the entire basin portion 100 more beautiful, two protrusions are provided, and the two protrusions are symmetrically distributed in the left-right direction of the filth receiving surface 10.

Optionally, the first flow guide portion has a first receiving surface formed on one side of the water outlet and a second receiving surface formed on another side of the water outlet in the left-right direction of the filth receiving surface, the second receiving surface is formed at a height lower than the first receiving surface, and a rear end of the second receiving surface is directed toward the inlet of the sewage pipe. For example, the first receiving surface on the left side spirals downward or smoothly transitions downward to the second receiving surface on the right side, so that the washing water flows downward from the first receiving surface to the second receiving surface and then to the inlet of the sewage pipe to form the first water flow F1. In addition, in order to better guide the washing water toward the inlet of the sewage pipe, the first flow guide portion may have a groove formed on the front portion of the filth receiving surface, and the groove is inclined downward toward the inlet of the sewage pipe. The groove may be arranged independently or on the front surface of the protrusion 51 in this embodiment. The specific design of the first flow guide portion is not limited to this.

A second flow guide portion 60, configured to guide the washing water to rotate along the peripheral wall 32 of the recess, is formed at a rear portion of the filth receiving surface 10. Specifically, the second flow guide portion 60 may be a flow guide wall surface formed at the rear portion of the filth receiving surface 10, and the guide wall surface is smoothly connected to the water guide passage 21 and is in smooth transition with the peripheral wall 32 on the rear side of the recess. That is, the water guide passage 21 narrows at the rear portion of the filth receiving surface 10 or no substantially horizontal water guide passage 21 is provided at the rear portion of the filth receiving surface 10. Besides, the second flow guide portion 60 may have other structure, as long as it can guide the water at the rear portion of the filth receiving surface 10 to rotate along the peripheral wall 32 of the recess.

In this way, part of the washing water flowing out of the water outlet 40 forms a horizontal swirling flow in a counterclockwise direction along the water guide passage 21 and flows to the rear portion of the filth receiving surface 10. This part of the washing water is guided by the second flow guide portion 60 to rotate along the peripheral wall 32 of the recess to form a second water flow F2. The first water flow F1 and the second water flow F2 act together to generate a vortex to agitate the filth and discharge the filth from the sewage pipe 300.

In order to better form the rotating water flow along the peripheral wall 32 of the recess, a third flow guide portion 70 is formed on the filth receiving surface 10 close to the water outlet 40, the third flow guide portion 70 is an inclined surface formed on a front side of the water outlet 40, and the inclined surface smoothly transitions downward from the water outlet 40 to the peripheral wall 32 of the recess. Part of the water flowing out of the water outlet 40 is guided by the third flow guide portion 70 to rotate along the peripheral wall 32 of the recess to form a third water flow F3, and a rotation direction of the third water flow F3 is consistent with a rotation direction of the second water flow F2.

Figure 4:
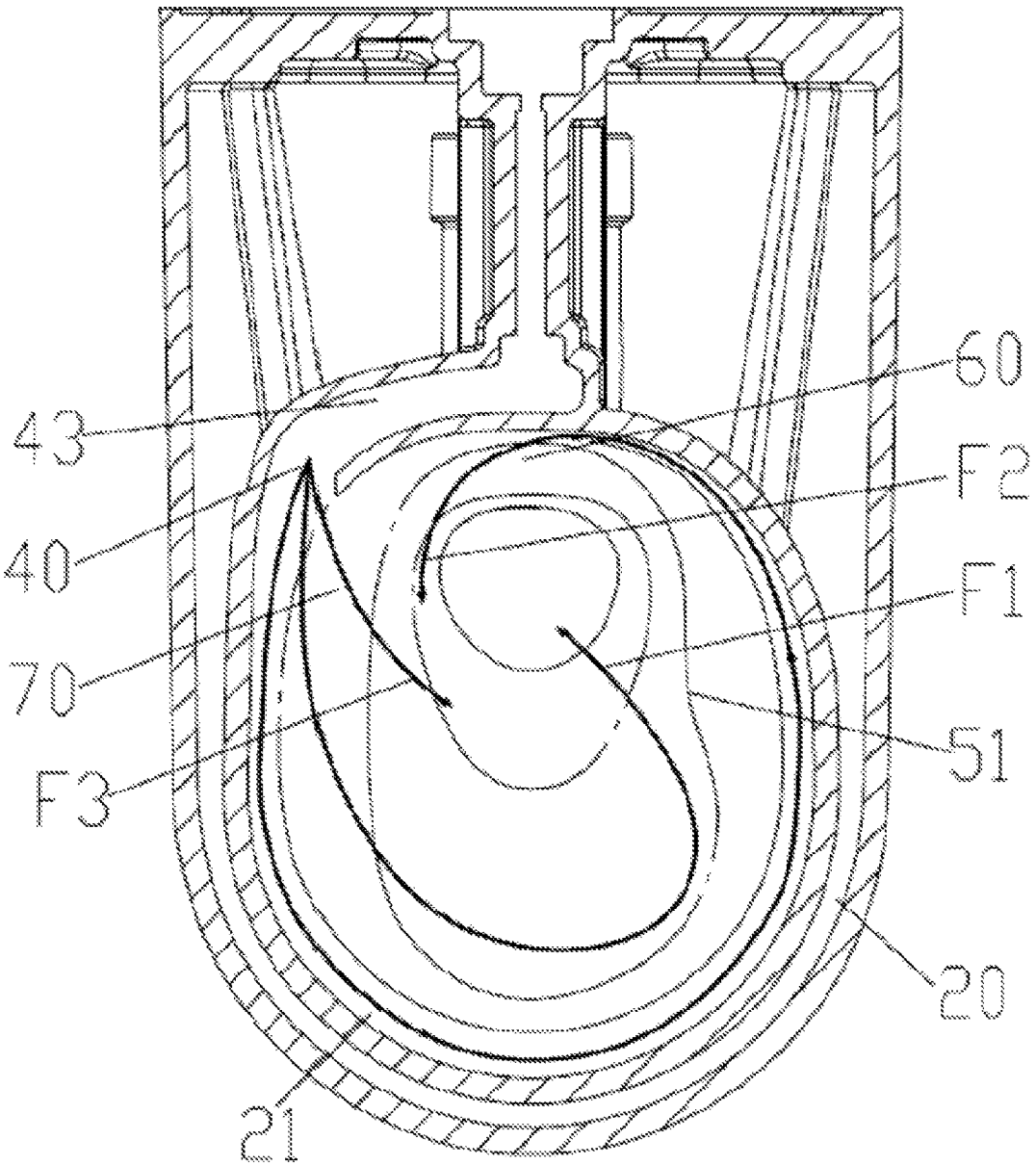
FIG. 4 is a schematic view of a flow direction of washing water of the flush toilet according to the present application.
Figure 5:
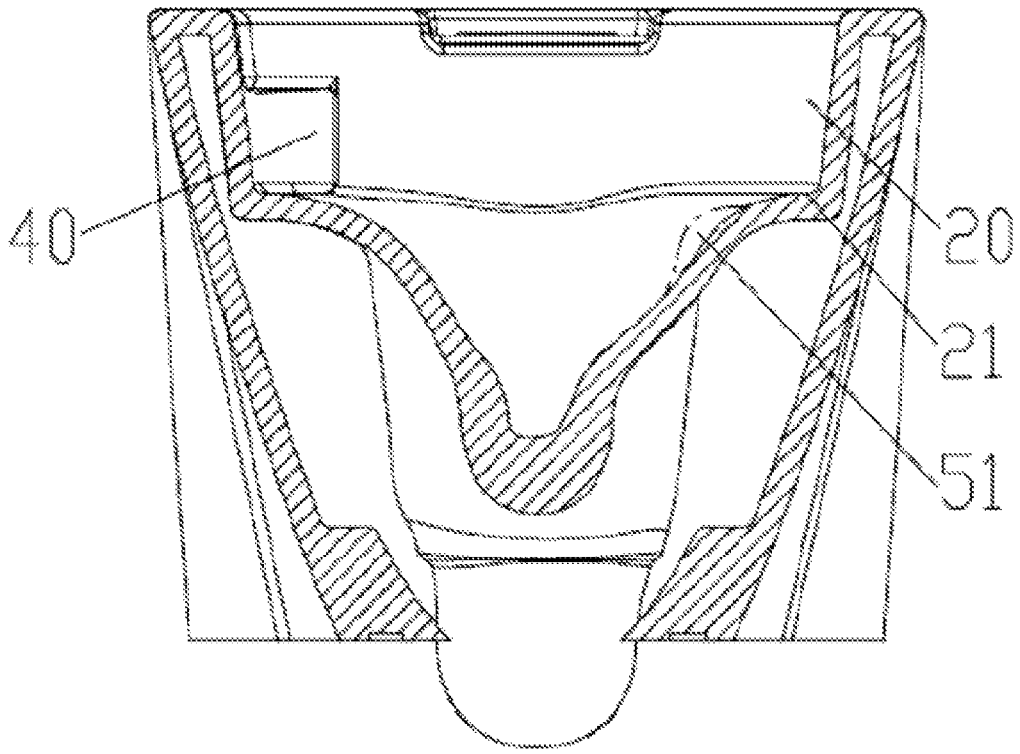
FIG. 5 is a sectional view of the flush toilet taken along C-C of FIG. 1 according to the present application.

FIG. 4 is a schematic view of the flow direction of washing water of the flush toilet according to an embodiment of the present application. When a user turns on the flushing switch (not shown), a drainage port in the water storage tank is opened, the washing water flows into the water inlet 41 of the washing water supply portion 200, and the water flowing in from the water inlet 41 is throttled by the throttling port 44 and then flows from the first water inlet pipe 42 to the second water inlet pipe 43, and then flows from the second water inlet pipe 43 to the water outlet 40. Since the flow sectional area of the first water inlet pipe 42 is larger than the flow sectional area of the throttling port 44, and the flow sectional area of the second water inlet pipe 43 is larger than the flow sectional area of the first water inlet pipe 42, the second water inlet pipe 43 gradually widens to the water outlet 40. Therefore, the water flowing out of the water storage tank is decelerated by the first water inlet pipe before flowing to the second water inlet pipe, and is again decelerated by the second water inlet pipe before flowing to the water outlet, so that the noise generated by entering of water is significantly reduced.

A part of the washing water flowing out of the water outlet 40 flows forward to the front portion of the filth receiving surface 10; this part of the washing water is guided by the first flow guide portion 50 and is blocked at the protrusion 51 and flows backward from the flow guide surface 52 toward the inlet of the sewage pipe to form the first water flow F1; this part of the washing water falls from the peripheral wall 32 of the recess to the bottom surface 31 of the recess, and then flows to the introduction pipe 81.

In addition, a part of the washing water flowing out of the water outlet 40 flows forward along the water guide passage 21, and flows along the inner peripheral surface of the inner edge portion 20 to the rear portion of the filth receiving surface 10 to generate swirling under the guidance of the water guide passage 21. This part of the washing water flows to the second flow guide portion 60 located at the rear portion of the filth receiving surface 10, and the washing water swirls and falls under the guidance of the second flow guide portion 60, and rotates along the peripheral wall 32 of the recess to form the second water flow F2.

Besides, a part of the washing water flowing out of the water outlet 40 directly flows to the third flow guide portion 70 close to the water outlet 40, and rotates along the peripheral wall 32 of the recess under the guidance of the third flow guide portion 70 to form the third water flow F3. The rotation direction of the third water flow F3 is consistent with the rotation direction of the second water flow F2. The above first water flow F1, the second water flow F2 and the third water flow F3 act together to generate the vortex to agitate the filth and discharge the filth from the sewage pipe 300.

Figure 6:
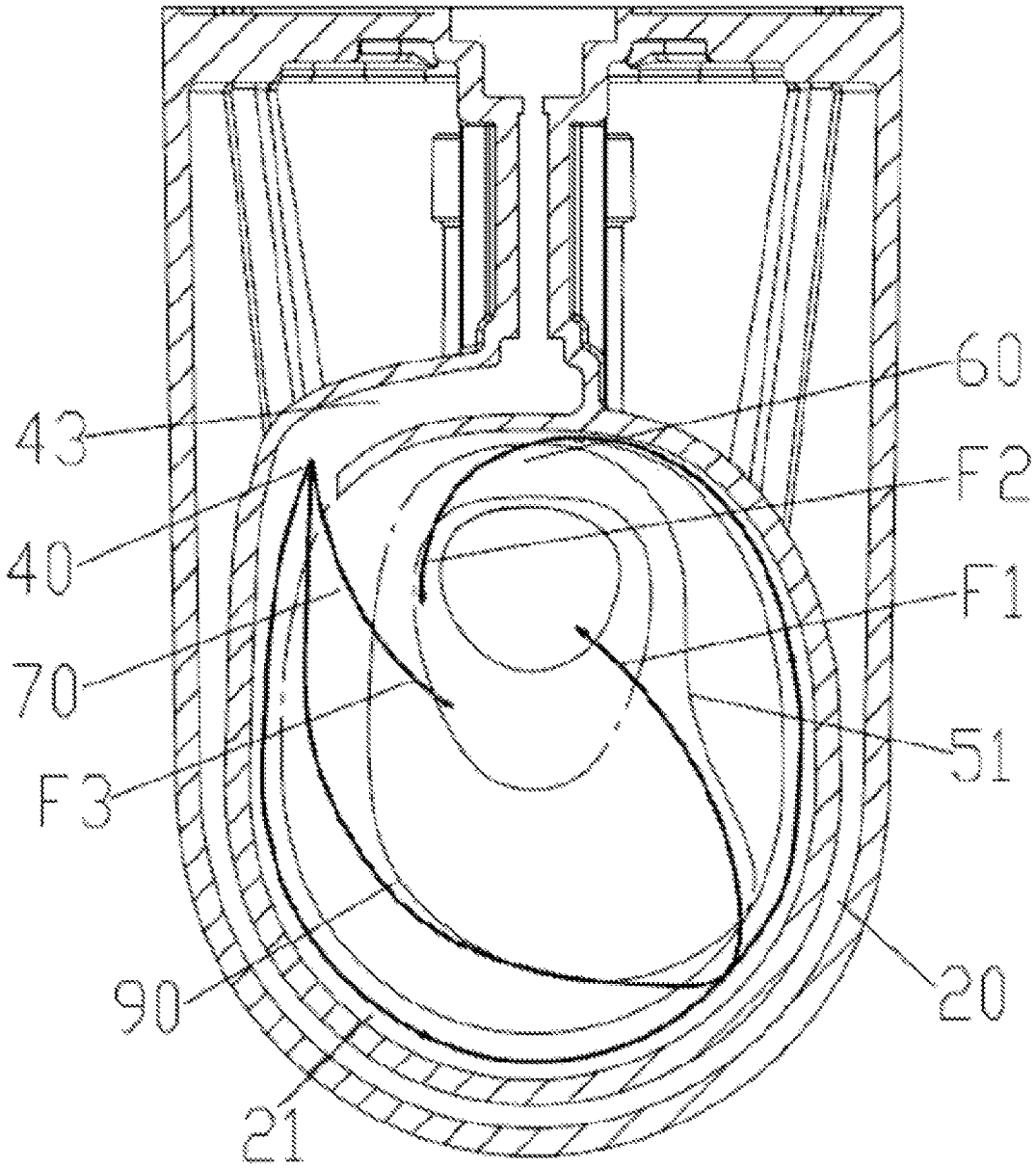
FIG. 6 is a schematic view of a flow direction of washing water of the flush toilet according to another embodiment of the present application.

As another embodiment of the present application, as shown in FIG. 6, the filth receiving surface 10 is formed with a fourth flow guide portion 90 on one side of the washing water supply portion 200, the washing water flowing out from the water outlet 40 to the front portion of the filth receiving surface 10 is guided by the fourth flow guide portion 90 to converge with the washing water flowing out of the water outlet 40 and along the inner peripheral surface of the inner edge portion 20, and most of the washing water after confluence forms the first water flow F1 under guidance of the first flow guide portion 50. Another part of water continuously flows to the rear portion of the filth receiving surface along the inner peripheral surface of the inner edge portion 20, and rotates along the peripheral wall 32 of the recess under the guidance of the second flow guide portion 60 to form the second water flow F2.

The present application is not only applicable to the flush toilet with the water storage tank, but also to a flush toilet using a pressure storage mechanism or a flush toilet directly using tap water as washing water. Although the present application is used in the direct-flush toilet in this embodiment, the present application is also applicable to a siphon-flush toilet, a siphon-spraying flush toilet with a spraying port.

The preferred embodiments of the present application are shown and described above. It should be understood that the present application is not limited to the form disclosed herein, and should not be regarded as an exclusion of other embodiments, but may be used in various other combinations, modifications and environments, and may be modified through the above teachings or technology or knowledge in related fields within the scope of the inventive concept of the present application. However, the modifications and changes made by those skilled in the art do not deviate from the spirit and scope of the present application, and shall be within the protection scope of the claims attached to the present application.

The invention claimed is:

1. A flush toilet, comprising a washing water supply portion which has a water outlet and a water inlet configured to connect to an external water supply pipe, wherein the flush toilet further comprises a basin portion and a sewage pipe, wherein the basin portion has a filth receiving surface, an inner edge portion formed on an upper portion of the filth receiving surface, and a recess formed on a lower portion of the filth receiving surface; and the recess has a peripheral wall connected to the lower portion of the filth receiving surface;

an inlet of the sewage pipe is in communication with the recess; and a first flow guide portion is formed on the filth receiving surface, washing water flows out from the water outlet to a front portion of the filth receiving surface, and is guided by the first flow guide portion to flow toward the inlet of the sewage pipe to form a first water flow; a second flow guide portion is formed at a rear portion of the filth receiving surface, the washing water flows out along an inner peripheral surface of the inner edge portion from the water outlet to the rear portion of the filth receiving surface, and is guided by the second flow guide portion to rotate along a peripheral wall of the recess to form a second water flow; and the first water flow and the second water flow act together to generate a vortex to agitate filth and discharge the filth from the sewage pipe, wherein the first flow guide portion has a protrusion formed on the filth receiving surface, and the protrusion is formed by protruding inward one side surface of the filth receiving surface in a left-right direction.

2. The flush toilet according to claim 1, wherein the number of the protrusion is two, and the two protrusions are symmetrically distributed in the left- right direction of the filth receiving surface.

3. The flush toilet according to claim 1, wherein the protrusion is formed on a side opposite to the water outlet in the left-right direction, a front surface of the protrusion forms a flow guide surface of the first flow guide portion, and the flow guide surface is inclined downward toward the inlet of the sewage pipe.

4. The flush toilet according to claim 1, wherein a corner portion greater than 90 degrees is formed between a front surface of the protrusion and the filth receiving surface.

5. The flush toilet according to claim 1, wherein the washing water flowing out from the water outlet to the front portion of the filth receiving surface partially collides with the protrusion to roll, and then falls from a side wall of the protrusion.

6. The flush toilet according to claim 1, wherein the first flow guide portion has a first receiving surface formed on one side of the water outlet and a second receiving surface formed on another side of the water outlet in the left-right direction of the filth receiving surface, the second receiving surface is formed at a height lower than the first receiving surface, and a rear end of the second receiving surface is directed toward the inlet of the sewage pipe.

7. The flush toilet according to claim 1, wherein the first flow guide portion has a groove formed on the front portion of the filth receiving surface, and the groove is inclined downward toward the inlet of the sewage pipe.

8. The flush toilet according to claim 1, wherein the second flow guide portion is a flow guide wall surface formed at a rear portion of the filth receiving surface, and the flow guide wall surface is in smooth transition with the peripheral wall on a rear side of the recess.

9. The flush toilet according to claim 1, wherein a third flow guide portion is formed on the filth receiving surface close to the water outlet, part of the water flowing out of the water outlet is guided by the third flow guide portion to rotate along the peripheral wall of the recess to form a third water flow, and a rotation direction of the third water flow is consistent with a rotation direction of the second water flow.

10. The flush toilet according to claim 9, wherein the third flow guide portion is an inclined surface formed on a front side of the water outlet, and the inclined surface smoothly transitions downward from the water outlet to the peripheral wall of the recess.

11. The flush toilet according to claim 1, wherein the recess has a bottom surface formed in a front region under a water sealing surface, the bottom surface is connected to the peripheral wall of the recess located on the front side; and, the bottom surface is formed substantially horizontally or is inclined backward and downward.

12. The flush toilet according to claim 11, wherein the bottom surface smoothly transitions downward from one side to another side in the left-right direction, and the transition from high to low of the bottom surface is consistent with the flow direction of the second water flow.

13. The flush toilet according to claim 1, wherein the filth receiving surface is formed with a fourth flow guide portion on one side of the washing water supply portion, the washing water flowing out from the water outlet to the front portion of the filth receiving surface is guided by the fourth flow guide portion to converge with the washing water flowing out of the water outlet and along the inner peripheral surface of the inner edge portion, and most of the washing water after confluence forms the first water flow under guidance of the first flow guide portion.

14. The flush toilet according to claim 1, wherein water flowing in from the water inlet flows from a first water inlet pipe to a second water inlet pipe, and then flows from the second water inlet pipe to the water outlet, a flow sectional area of the first water inlet pipe is smaller than a flow sectional area of the water inlet, and a flow sectional area of the second water inlet pipe is larger than the flow sectional area of the first water inlet pipe.

15. The flush toilet according to claim 14, wherein the flow sectional area of the first water inlet pipe is 30% to 75% of the flow sectional area of the water inlet, and the flow sectional area of the second water inlet pipe is 5/3 to 35/12 of the flow sectional area of the first water inlet pipe.

16. The flush toilet according to claim 14, wherein the water flowing in from the water inlet is throttled by a throttling port, and then flows from the first water inlet pipe to the second water inlet pipe, and a flow sectional area of the throttling port is 25% to 50% of the flow sectional area of the water inlet.

17. The flush toilet according to claim 14, wherein the flow sectional area of the water outlet is 75% to 200% of the flow sectional area of the water inlet.

18. The flush toilet according to claim 14, wherein the second water inlet pipe gradually widens to the water outlet.

19. The flush toilet according to claim 14, wherein the washing water supply portion has only one water outlet in communication with the water inlet; and the water outlet is located on a rear side of a recess or a rear portion of a recess in a front-rear direction.

* * * * *